US011333162B2

(12) United States Patent
Morikawa et al.

(10) Patent No.: US 11,333,162 B2
(45) Date of Patent: May 17, 2022

(54) IMPELLER MANUFACTURING METHOD AND IMPELLER FLOW PATH ELONGATION JIG

(71) Applicant: MITSUBISHI HEAVY INDUSTRIES COMPRESSOR CORPORATION, Tokyo (JP)

(72) Inventors: Akihiko Morikawa, Hiroshima (JP); Kosei Kawahara, Hiroshima (JP); Toyoaki Yasui, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 57 days.

(21) Appl. No.: 16/478,390

(22) PCT Filed: Feb. 24, 2017

(86) PCT No.: PCT/JP2017/007205
§ 371 (c)(1),
(2) Date: Jul. 16, 2019

(87) PCT Pub. No.: WO2018/154730
PCT Pub. Date: Aug. 30, 2018

(65) Prior Publication Data

US 2019/0376526 A1 Dec. 12, 2019

(51) Int. Cl.
*F04D 29/28* (2006.01)
*B24C 1/08* (2006.01)
(Continued)

(52) U.S. Cl.
CPC ..... *F04D 29/284* (2013.01); *B24B 31/116* (2013.01); *B24C 1/083* (2013.01);
(Continued)

(58) Field of Classification Search
CPC ..... F04D 29/284; F04D 29/023; F04D 29/60; B24C 1/08; B24C 1/083; B24C 5/06;
(Continued)

(56) References Cited

U.S. PATENT DOCUMENTS 3,768,209 A * 10/1973 Punter ..... B24C 5/06 451/97
4,740,138 A * 4/1988 Zaehring ..... F01D 17/14 415/12

(Continued)

FOREIGN PATENT DOCUMENTS

JP S52-111492 U 8/1977
JP S57-211469 A 12/1982

(Continued)

OTHER PUBLICATIONS

International Search Report and Written Opinion in corresponding International Application No. PCT/JP2017/007205, dated Apr. 18, 2017 (14 pages).

(Continued)

*Primary Examiner* — Monica S Carter
*Assistant Examiner* — Marcel T Dion
(74) *Attorney, Agent, or Firm* — Osha Bergman Watanabe & Burton LLP

(57) ABSTRACT

An impeller manufacturing method includes: integrally forming an impeller by an additive manufacturing method using a metal powder, the impeller including a disk which has a disk shape about an axis, a plurality of blades which are formed on a surface facing a first side in an axial direction of the disk with gaps therebetween in a circumferential direction about the axis, and a cover which covers the plurality of blades from the first side in the axial direction; processing the integrally formed impeller by a hot isostatic pressing; and causing a polishing fluid containing (Continued)

abrasive grains to flow through a flow path formed between the disk, the cover, and the blades in the impeller after the processing with the hot isostatic pressing and while pressurizing the polishing fluid to perform fluid polishing.

3 Claims, 3 Drawing Sheets

(51) Int. Cl.
*B24B 31/116* (2006.01)
*B24C 3/32* (2006.01)
*F04D 29/02* (2006.01)
*F04D 29/60* (2006.01)

(52) U.S. Cl.
CPC ..... *B24C 3/327* (2013.01); *F04D 29/023* (2013.01); *F04D 29/60* (2013.01); *F05D 2250/621* (2013.01)

(58) Field of Classification Search
CPC ..... B24C 3/327; B24B 31/006; B24B 31/116; B22F 3/04; B22F 3/10; B22F 3/15; B22F 3/16
USPC ..... 451/36, 439, 440
See application file for complete search history.

(56) References Cited

U.S. PATENT DOCUMENTS 5,176,499 A * 1/1993 Damlis ..... B23P 15/04 29/888.024
2003/0115922 A1 6/2003 Berthelet et al.
2004/0266320 A1* 12/2004 Walch ..... B24B 49/16 451/36
2005/0127205 A1* 6/2005 Fath ..... B24B 31/116 239/223
2008/0256926 A1* 10/2008 Ziaei ..... F04D 29/441 60/269
2009/0110556 A1* 4/2009 Jahnz ..... F04D 29/023 416/179
2010/0099335 A1 4/2010 Sasu et al.
2011/0108526 A1 5/2011 Kishimoto et al.
2015/0060403 A1 3/2015 Carter et al.
2016/0082565 A1* 3/2016 Kenda ..... B24B 31/116 451/36
2016/0167196 A1* 6/2016 Beckman ..... B24C 1/083 451/38
2018/0141124 A1 5/2018 Thon
2018/0148814 A1* 5/2018 Lukezic ..... F01D 25/005
2018/0209275 A1* 7/2018 Abrari ..... B33Y 80/00
2019/0134779 A1* 5/2019 Kawasumi ..... B24C 3/325

FOREIGN PATENT DOCUMENTS

JP 2010-89190 A 4/2010
JP 2014-094433 A 5/2014
JP 2015-510979 A 4/2015
JP 2016-037901 A 3/2016
JP 2016-533433 A 10/2016
JP 2017-36484 A 2/2017
WO 2013-124314 A1 8/2013
WO 2016-184685 A1 11/2016

OTHER PUBLICATIONS

Decision to Grant in corresponding Japanese Application No. 2017-563269, dated Jan. 9, 2018 (5 pages).

* cited by examiner

IMPELLER MANUFACTURING METHOD AND IMPELLER FLOW PATH ELONGATION JIG

TECHNICAL FIELD

The present invention relates to an impeller manufacturing method and an impeller flow path elongation jig.

BACKGROUND ART

For example, an impeller used in a rotary machine such as a centrifugal compressor includes a disk, a blade, and a cover. The disk is fixed to a rotary shaft provided in the rotary machine. A plurality of the blades are provided on a surface of the disk with gaps therebetween in a circumferential direction. The cover covers the blades from a side opposite to the disk. In the impeller, a portion between the disk, cover, and the blades adjacent to each other in the circumferential direction is a flow path through which a fluid flows.

For example, Patent Document 1 describes a method of forming an impeller by a additive manufacturing method. In the additive manufacturing method, a metal powder which is disposed to match a shape of a desired impeller is sintered by thermal energy generated by laser, an electron beam, or the like. Steps of disposing and sintering the metal powder are sequentially repeated, and thus, the sintered metal powders are laminated, and an impeller having a desired shape is formed.

CITATION LIST

Patent Literature

[Patent Document 1] Japanese Unexamined Patent Application, First Publication No. 2016-37901

SUMMARY OF INVENTION

Technical Problem

Meanwhile, compared to an impeller formed by a machining, in an impeller formed by a additive manufacturing method, not only a surface roughness increases but also a variation in the surface roughness increases. Accordingly, a polishing method such as electropolishing or chemical polishing, in some cases, surface irregularities on an inner peripheral surface of a flow path cannot be uniformly decreased, and a predetermined surface roughness cannot be obtained. In addition, the flow path formed inside the impeller has a complicated shape, and thus, it is difficult to polish the entire inner peripheral surface of the flow path by mechanical polishing.

The present invention provides an impeller manufacturing method and an impeller flow path elongation jig capable of favorably polishing the inner peripheral surface of the flow path while forming the impeller by the additive manufacturing method.

Solution to Problem

According to a first aspect of the present invention, there is provided an impeller manufacturing method including: an impeller forming step of integrally forming an impeller by a additive manufacturing method using a metal powder, the impeller including a disk which has a disk shape about an axis, a plurality of blades which are formed on a surface facing a first side in an axial direction of the disk with gaps therebetween in a circumferential direction about the axis, and a cover which covers the plurality of blades from the first side in the axial direction; an HIP processing step of processing the impeller, which is formed in the impeller forming step, by a hot isostatic pressing; and a flow path polishing step of causing a polishing fluid containing abrasive grains to flow through a flow path formed between the disk, the cover, and the blades in the impeller after the HIP processing step while pressurizing the polishing fluid to perform fluid polishing.

According to this configuration, the impeller is formed by the additive manufacturing method, and thus, it is possible to form the impeller without performing welding. Accordingly, a strength of a base material of the impeller and a strength of a welded portion are the same as each other, and thus, the entire strength of the impeller is not uneven. Accordingly, it is possible to integrally form a homogenous impeller. Moreover, the impeller is processed by the hot isostatic pressing, and thus, internal defects such as voids in the base material of the impeller are removed. As a result, it is possible to improve the strength of the impeller. In addition, even in a case where a cross-sectional area of the flow path of the impeller is small, it is possible to reliably polish an inner peripheral surface of the flow path by the fluid polishing.

In the impeller manufacturing method according to a second aspect of the present invention, in the first aspect, in the flow path polishing step, a flow path elongation jig having an elongation flow path which extends to elongate the flow path by communicating with an outlet of the flow path may be mounted radially outside the impeller and the fluid polishing may be performed.

According to this configuration, the polishing fluid flows from the outlet of the flow path into the elongation flow path of the flow path elongation jig. Accordingly, it is possible to prevent the flow path cross-sectional area of the flow path through which the polishing fluid flows from rapidly increasing in the vicinity of the outlet. Accordingly, when the polishing fluid flows out from the outlet of the flow path, the pressure of the flow path in the vicinity of the outlet is prevented from decreasing. Therefore, also in the outlet of the flow path, it is possible to favorably polish the inner peripheral surface of the flow path.

In the impeller manufacturing method according to a third aspect of the present invention, in the second aspect, a flow path width of the elongation flow path when viewed in the axial direction may extend to have the same constant length as a flow path width at the outlet of the flow path of the impeller.

According to this configuration, it is possible to limit a pressure change of the polishing fluid in the elongation flow path with high accuracy. Therefore, polishing conditions between the outlet of the flow path and other portions of the flow path can be brought closer to each other, and more uniform polishing can be performed.

In the impeller manufacturing method according to a fourth aspect of the present invention, in the second or third aspect, the elongation flow path may be formed to linearly extend in a direction in which the flow path extends at the outlet of the flow path.

According to this configuration, it is possible to prevent a flow direction of the polishing fluid from being changed in the elongation flow path. If the flow direction of the polishing fluid is changed in the elongation flow path, the pressure of the polishing fluid is changed. As a result, the polishing at the outlet of the flow path may be adversely affected. Meanwhile, the outlet of the flow path linearly extends to be elongated without curving the elongation flow path, and thus, it is possible to prevent the polishing at the outlet of the flow path from being adversely affected.

According to a fifth aspect of the present invention, there is provided an impeller flow path elongation jig which is used to perform fluid polishing of causing a polishing fluid containing abrasive grains to flow through a flow path formed by a disk, a cover, and a plurality of blades in an impeller while pressurizing the polishing fluid, the impeller including the disk which has a disk shape about an axis, the plurality of blades which are formed on a surface facing a first side in an axial direction of the disk with gaps therebetween in a circumferential direction about the axis, and the cover which covers the plurality of blades from the first side in the axial direction, the jig including: a jig body which is attachable to radially outside the impeller and in which an elongation flow path extending to penetrate the jig body is formed therein, in which the elongation flow path is formed to communicate with an outlet of the flow path in a state where the jig body is mounted on the impeller.

According to this configuration, the elongation flow path of the flow path elongation jig is provided, and thus, it is possible to prevent the flow path cross-sectional area of the flow path through which the polishing fluid flows from rapidly increasing in the vicinity of the outlet. Accordingly, when the polishing fluid flows out from the outlet of the flow path, the pressure of the flow path in the vicinity of the outlet is prevented from decreasing. Therefore, also in the outlet of the flow path, it is possible to favorably polish the inner peripheral surface of the flow path.

Advantageous Effects of Invention

According to the present invention, it is possible to favorably polish the inner peripheral surface of the flow path while forming the impeller by the additive manufacturing method.

DESCRIPTION OF EMBODIMENTS

Figure 1:
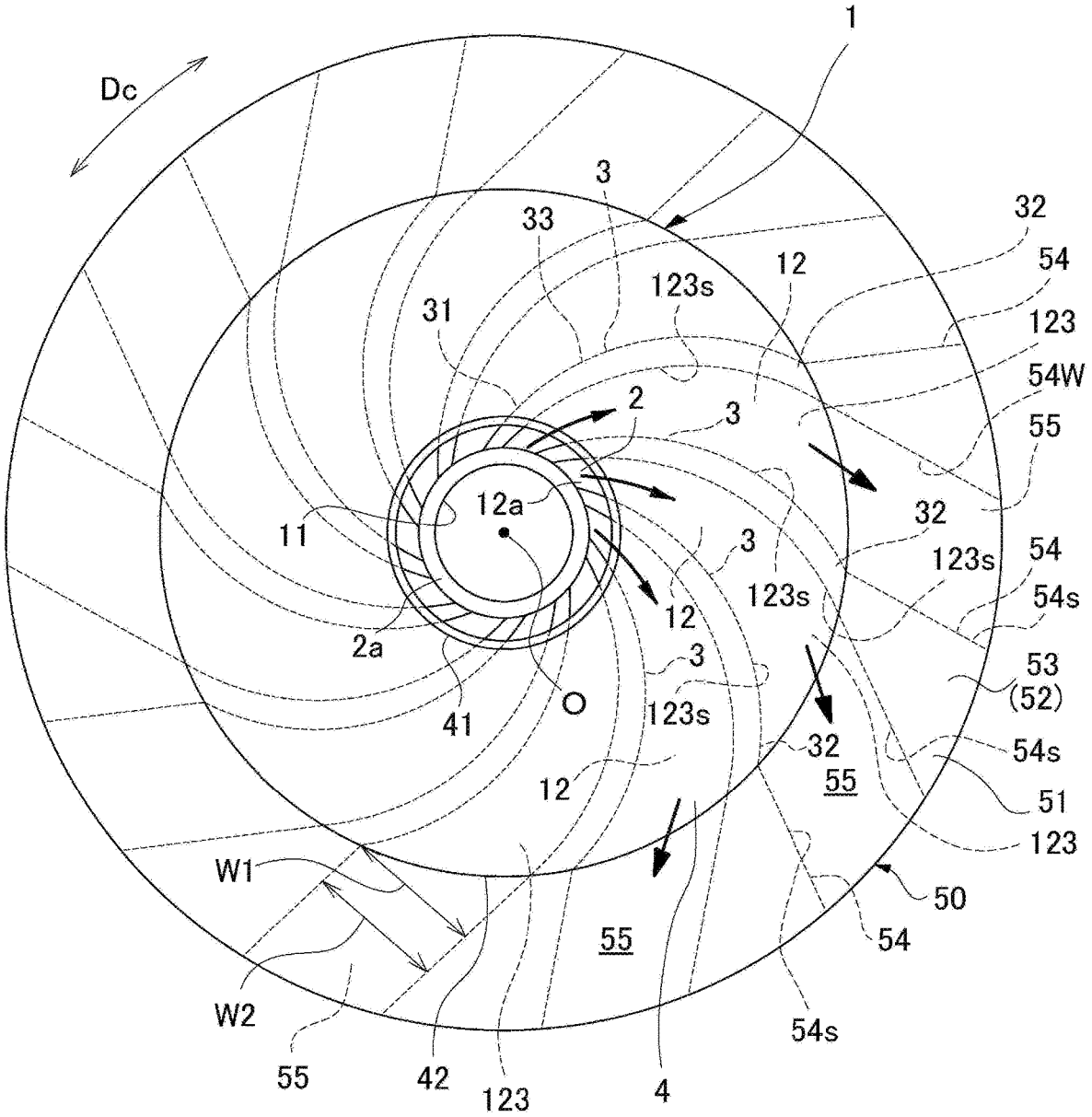
FIG. 1 is a view when an impeller manufactured by an impeller manufacturing method and an impeller flow path elongation jig in an embodiment of the present invention are viewed in an axial direction of the impeller.
Figure 2:
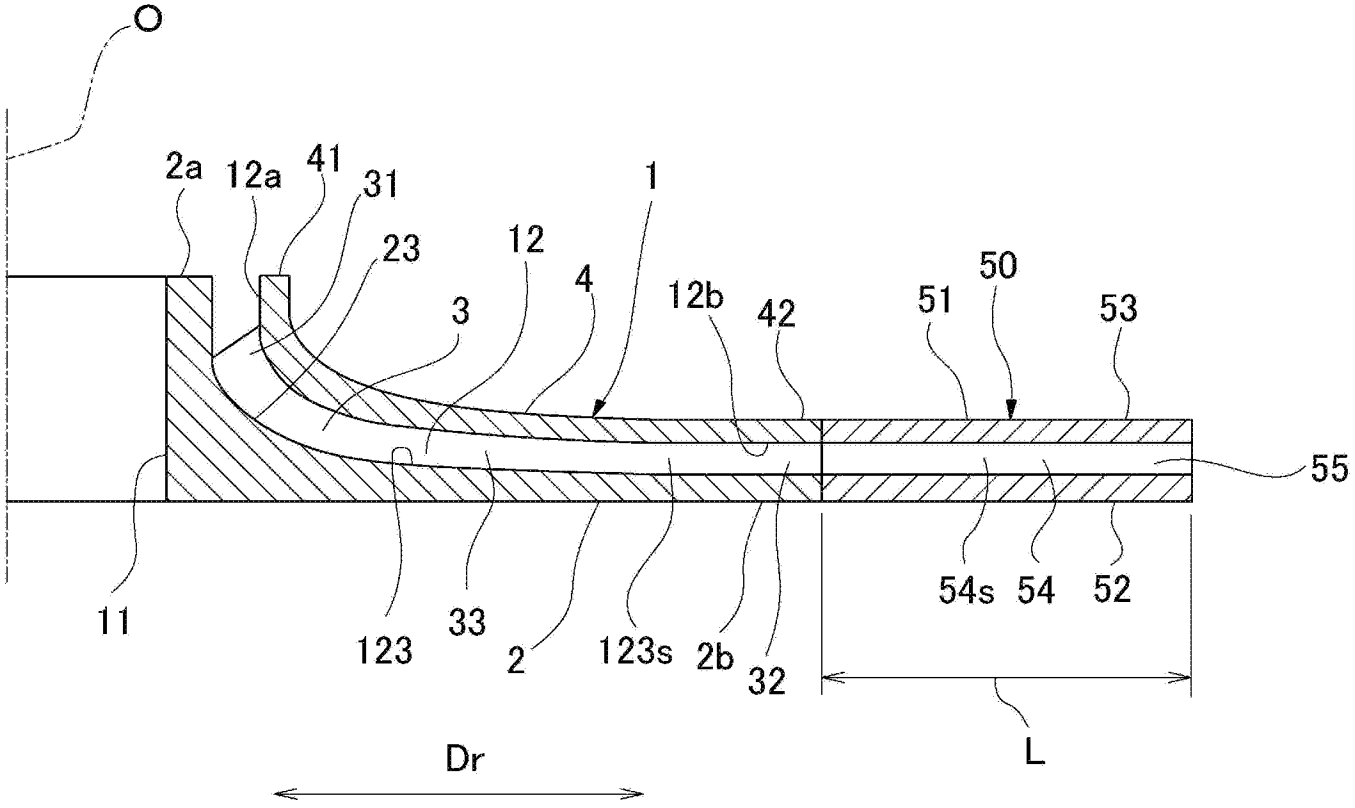
FIG. 2 is a half sectional view when the impeller and the flow path elongation jig shown in FIG. 1 are taken along an axis of the impeller.
Figure 3:
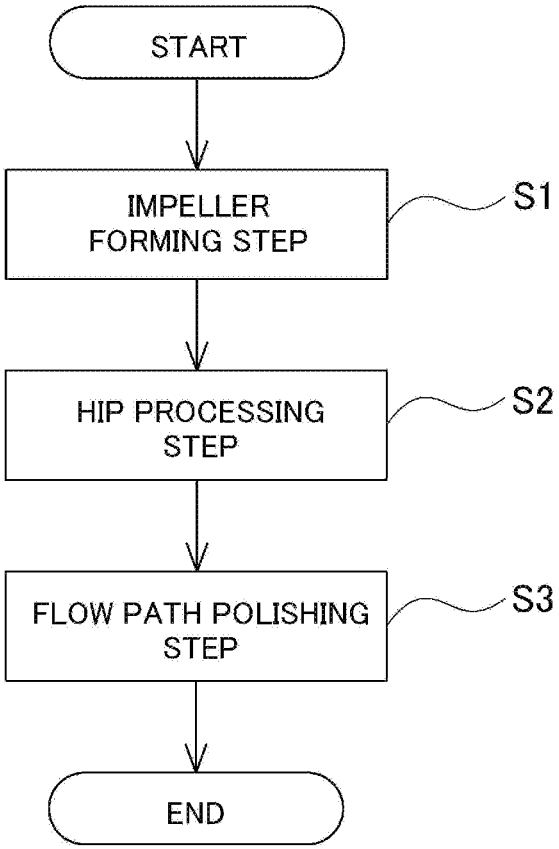
FIG. 3 is a flowchart showing a flow of the impeller manufacturing method in the embodiment of the present invention.

Hereinafter, an impeller manufacturing method and an impeller flow path elongation jig of the present invention will be described with reference to the drawings. FIG. 1 is a view when an impeller manufactured by the impeller manufacturing method and the impeller flow path elongation jig in the embodiment of the present invention are viewed in an axial direction of the impeller. FIG. 2 is a half sectional view when the impeller and the flow path elongation jig shown in FIG. 1 are taken along an axis of the impeller. FIG. 3 is a flowchart showing a flow of the impeller manufacturing method in the embodiment of the present invention.

For example, an impeller 1 manufactured according to the present embodiment is mounted on a rotary machine such as a centrifugal compressor. As shown in FIGS. 1 and 2, the impeller 1 includes a disk 2, blades 3, and a cover 4.

The disk 2 has an approximately circular shape when viewed in an axis O direction in which the axis O extends. The disk 2 is formed in a disk shape about the axis O. More specifically, the disk 2 is formed such that dimensions of the disk 2 in radial direction Dr about the axis O gradually increases from an end portion 2*a* on a first side (upper side in FIG. 2) in the axis O direction toward an end portion 2*b* on a second side (lower side in FIG. 2). The disk 2 has a curved surface 23, which is curved to be recessed toward the second side (end portion 2*b* side) in the axis O direction, as a surface facing the first side (end portion 2*a* side) in the axis O direction.

Moreover, a shaft insertion hole 11 which penetrates the disk 2 in the axis O direction is provided at a center of the disk 2. A rotary shaft (not shown) of the rotary machine is inserted into the shaft insertion hole 11 in the axis O direction. Accordingly, the impeller 1 can be integrally rotated with the rotary shaft of the rotary machine.

The blades 3 are formed to be erected from the curved surface 23 of the disk 2 toward the first side in the axis O direction. The plurality of blades 3 are formed on the curved surface 23 with gaps therebetween in a circumferential direction C about the axis O. Each blade 3 extends to be separated from the disk 2 and is formed to extend from an inner side (shaft insertion hole 11 side) of the disk 2 in the radial direction Dr toward an outer side thereof. In addition, in each blade 3, an intermediate portion 33 in the radial direction Dr is curvedly formed to be recessed toward the first side in the circumferential direction Dc with respect to an inner-side end portion 31 in the radial direction Dr and an outer-side end portion 32 in the radial direction Dr.

The cover 4 is provided at interval in the axis O direction with respect to the curved surface 23 of the disk 2. The cover 4 is provided to cover the plurality of blades 3 from the first side in the axis O direction. The cover 4 has a disk shape about the axis O. Specifically, the cover 4 has an umbrella shape in which a diameter gradually decreases from the second side in the axis O direction toward the first side. An inner peripheral end portion 41 of the cover 4 is disposed with a gap in the radial direction Dr between the inner peripheral end portion 41 and the end portion 2*a* of the disk 2. Accordingly, a portion between the inner peripheral end portion 41 of the cover 4 and the end portion 2*a* of the disk 2 is open toward the first side in the axis O direction. In addition, the cover 4 is disposed with a gap in the axis O direction between the cover 4 and the end portion 2*b* of the disk 2. Accordingly, a portion between an outer peripheral end portion 42 of the cover 4 and the end portion 2*b* of the disk 2 is open toward the outside in the radial direction Dr.

Flow paths 12 are formed inside the impeller 1 by the disk 2, the cover 4, and the blades 3. Each flow path 12 is defined by the blades 3 adjacent to each other in the circumferential direction Dc between the disk 2 and the cover 4. The impeller 1 has the plurality of flow paths 12 in the circumferential direction Dc. Each flow path 12 has a flow path inlet 12*a* which is open toward the first side in the axis O direction between the end portion 2*a* of the disk 2 and the inner peripheral end portion 41 of the cover 4. In addition, each flow path 12 has a flow path outlet 12*b* which is open toward the outside in the radial direction Dr between the end portion 2*b* of the disk 2 and the outer peripheral end portion 42 of the cover 4. An inner peripheral surface 123 of the flow path 12 is constituted by the curved surface 23 of the disk 2, the surface of the cover 4 facing the second side in the axis O direction, and the surface of the blade 3 facing the circumferential direction.

A gap between the disk 2 and the cover 4 is formed to be gradually narrowed from the inside in the radial direction Dr toward the outside. In addition, a gap (hereinafter, this gap is referred to as a flow path width) in the circumferential direction Dc between the blades 3 adjacent to each other in the circumferential direction DC is formed to be gradually widened from the flow path inlet 12*a* toward the flow path outlet 12*b*. Each flow path 12 is formed such that a flow path cross-sectional area thereof gradually decreases from the flow path inlet 12*a* toward the flow path outlet 12*b*.

Next, a manufacturing method of the impeller 1 will be described.

As shown in FIG. 3, the manufacturing method of the impeller 1 in the present embodiment includes an impeller forming step S1, an HIP processing step S2, and a flow path polishing step S3.

The impeller forming step S1 is integrally formed by a additive manufacturing method using a metal powder. In the impeller forming step S1 of the present embodiment, a predetermined metal powder forming the impeller 1 is disposed and is irradiated with thermal energy such as laser or an electron beam to match a desired sectional shape of the impeller 1. The metal powder is sintered by the thermal energy of the laser or the electron beam. Thereafter, the metal powder is disposed again and is irradiated with the thermal energy. In this way, by sequentially repeating the disposition of the metal powder and the irradiation of the thermal energy, the impeller 1 having a desired shape is laminated. Accordingly, the impeller 1 in which the disk 2, the blades 3, and the cover 4 are integrated with each other is formed.

In the HIP processing step S2, the impeller 1 formed in the impeller forming step S1 is processed by a hot isostatic pressing (HIP). In the HIP processing step S2, the laminated impeller 1 is accommodated in a pressure container (not shown) filled with an inert gas such as argon and is pressurized at a predetermined temperature. Accordingly, an isotropic pressure is applied to the impeller 1 using the inert gas as a pressure medium. Voids generated in the impeller 1 formed in the impeller forming step S1 are crimped by the hot isostatic pressing.

In the flow path polishing step S3, a polishing fluid containing abrasive grains flows through the flow paths of the impeller 1 after the HIP processing step S2 while being pressurized, and thus, fluid polishing is performed on the impeller 1. Specifically, in the flow path polishing step S3, the polishing fluid is moved while being pressurized from the flow path inlet 12*a* toward the flow path outlet 12*b*. Accordingly, the inner peripheral surface 123 of each flow path 12 is polished, and a predetermined surface roughness is obtained.

Moreover, the flow path polishing step S3 is not limited to the polishing fluid being pressurized from the flow path inlet 12*a* toward the flow path outlet 12*b*. For example, in the flow path polishing step S3, the polishing fluid may be pressurized from the flow path outlet 12*b* toward the flow path inlet 12*a* so as to reciprocate the polishing fluid in the flow path 12.

Here, in a state before the polishing, compared to a case where the impeller 1 is formed by machining such as cutting, in the inner peripheral surface 123 of the flow path 12 of the impeller 1 formed by the additive manufacturing method, not only the entire surface roughness increases but also a variation in the surface roughness for each region increases. Accordingly, for example, if polishing such as electropolishing or chemical polishing is performed on the inner peripheral surface 123 having a large variation in the surface roughness, efficiency decreases, and it is difficult to uniformly remove irregularities of the surface of the inner peripheral surface 123. Meanwhile, since the fluid polishing is used, the irregularities of the inner peripheral surface 123 of the flow path 12 of the impeller 1 formed by the additive manufacturing method are effectively and uniformly removed, and a desired surface roughness for the entire inner peripheral surface 123 is obtained.

In the flow path polishing step S3, as shown in FIGS. 1 and 2, after a flow path elongation jig 50 is mounted on the impeller 1, the fluid polishing is performed. The flow path elongation jig 50 is mounted outside the impeller 1 in the radial direction Dr. The flow path elongation jig 50 includes a jig body 51 in which elongation flow paths 55 are formed inside the jig body 51. Each elongation flow path 55 is formed to communicate with the flow path outlet 12*b* in a state where the jig body 51 is mounted on the impeller 1.

The jig body 51 is formed in an annular shape. The jig body 51 can be inserted into the impeller 1 in a state where an outer peripheral surface of the impeller 1 is in contact with the inner peripheral surface of the jig body 51. In the present embodiment, the jig body 51 includes a first plate 52, a second plate 53, and partition members 54.

The first plate 52 is disposed outside the end portion 2*b* of the disk 2 in the radial direction Dr in a state where the jig body 51 is mounted on the impeller 1. The first plate 52 is formed to extend toward the outside in the radial direction Dr to be continuous to the end portion 2*b* of the disk 2 in the state where the jig body 51 is mounted on the impeller 1.

The second plate 53 is disposed to face the first plate 52 with a gap therebetween in the axis O direction. The second plate 53 is disposed outside the cover 4 in the radial direction Dr in the state where the jig body 51 is mounted on the impeller 1. The second plate 53 is formed to extend toward the outside in the radial direction Dr to be continuous to the outer peripheral end portion 42 of the cover 4 in the state where the jig body 51 is mounted on the impeller 1.

The partition members 54 are disposed between the first plate 52 and the second plate 53. The plurality of partition members 54 are provided with gaps therebetween in the circumferential direction Dc around the axis O. In the present embodiment, the partition members 54 are connected to the first plate 52 and the second plate 53. Each partition member 54 is disposed outside in the radial direction Dr of the outer-side end portion 32 in the radial direction Dr of each blade 3 of the impeller 1 in the state where the jig body 51 is mounted on the impeller 1. Each partition member 54 is formed to extend toward the outside in the radial direction Dr to be continuous to the outer-side end portion 32 of each blade 3 in the radial direction Dr in the state where the jig body 51 is mounted on the impeller 1. Each partition member 54 includes partition wall surfaces 54*w*, which are continuous to side wall surfaces 123*s* of the flow path 12 formed by the blades 3, on both sides in the circumferential direction Dc.

Each elongation flow path 55 is formed by the partition members 54 adjacent to each other in the circumferential direction Dc between the first plate 52 and the second plate 53. In each elongation flow path 55, the partition members 54 on both sides in the circumferential direction Dc are formed to be parallel to each other. Accordingly, a flow path width W2 (a flow path width when viewed in the axis O direction) of the elongation flow path 55 in the circumferential direction Dc is constantly formed in the direction in which the elongation flow path 55 extends. In addition, the flow path width W2 of the elongation flow path 55 is the same as a flow path width W1 of the flow path outlet 12*b* of the flow path 12. The elongation flow path 55 linearly extends in a direction in which the flow path 12 extends at the flow path outlet 12*b* of the flow path 12 of the impeller 1.

Here, in the above-described flow path elongation jig 50, preferably, a length L in the radial direction Dr equal to or more than the flow path width W1 of the flow path 12 at the flow path outlet 12*b*. More preferably, the length L of the flow path elongation jig 50 in the radial direction Dr is more than twice the flow path width W1 of the flow path 12 at the flow path outlet 12*b*. Accordingly, it is possible to effectively limit a pressure change of the polishing fluid which has flowed from the flow path 12 into the elongation flow path 55. If the length L is too short, there is a possibility that the pressure change occurring in the polishing fluid radially flowing out from the elongation flow path 55 may extend to the polishing fluid in the flow path 12.

In the flow path polishing step S3, the above-described flow path elongation jig 50 is mounted outside the impeller 1 in the radial direction Dr, the polishing fluid is fed into each flow path 12 of the impeller 1, and thus, the inner peripheral surface 123 is polished. If the polishing fluid flows through the flow path 12 from the flow path inlet 12*a* side toward the flow path outlet 12*b*, the polishing fluid flows from the flow path outlet 12*b* into the elongation flow path 55 of the flow path elongation jig 50.

Here, for example, a case where the flow path elongation jig 50 is not mounted and the polishing fluid is fed into the flow path 12 is considered. In the case where the flow path elongation jig 50 is not mounted, when the polishing fluid flows out from the flow path outlet 12*b* to the outside in the radial direction Dr, a flow path cross-sectional area of the flow path 12 rapidly increases. As a result, a pressure of the polishing fluid flowing out from the flow path outlet 12*b* rapidly decreases. The decrease in the pressure of the polishing fluid also propagates to the flow path outlet 12*b* side. Accordingly, in the flow path outlet 12*b*, the inner peripheral surface 123 of the flow path 12 may not be sufficiently polished. In addition, conversely, in a case where the polishing fluid flows from the outside into the flow path outlet 12*b*, the flow path cross-sectional area rapidly decreases. As a result, the pressure of the polishing fluid entering the flow path outlet 12*b* rapidly increases. The flow path outlet 12*b* is extremely worn more than those of other flow paths by the increase in the pressure, and thus, the shape may not be retained.

Meanwhile, if the polishing fluid is fed into the flow path 12 in the state where the flow path elongation jig 50 is mounted, the polishing fluid flows into the elongation flow path 55 from the flow path outlet 12*b*. Accordingly, a rapid increase of the flow path cross-sectional area of the polishing fluid in the flow path outlet 12*b* is limited. Accordingly, it is possible to limit the decrease in the pressure of the polishing fluid in the flow path outlet 12*b*.

According to the manufacturing method of the impeller 1 of the above-described embodiment, the impeller 1 is formed by the additive manufacturing method, and thus, it is possible to form the impeller 1 without performing welding. Accordingly, a welded portion having a strength different from that of a base material is not generated in the impeller 1. Therefore, the strength of the base material of the impeller 1 and the strength of the welded portion are the same as each other, and thus, the entire strength of the impeller 1 is not uneven. Accordingly, it is possible to integrally form a homogenous impeller 1.

Moreover, the impeller 1 is processed by the hot isostatic pressing, and thus, internal defects such as voids in the base material of the impeller 1 are removed. As a result, it is possible to improve the strength of the laminated impeller 1.

In addition, even in a case where the cross-sectional area of the flow path 12 is small, it is possible to reliably polish the inner peripheral surface 123 of the flow path 12 by the fluid polishing. Accordingly, it is possible to favorably polish the inner peripheral surface 123 of the flow path 12 while forming the impeller 1 by the additive manufacturing method.

In addition, in a case where the inner peripheral surface 123 of the flow path 12 is polished by the fluid polishing method, the flow path elongation jig 50 is mounted on the impeller 1. Accordingly, it is possible to prevent the flow path cross-sectional area from rapidly increasing in a case where the polishing fluid flows out from the flow path outlet 12*b* and to prevent the pressure of the polishing fluid from decreasing. That is, it is possible to prevent the flow path cross-sectional area of the flow path through which the polishing fluid flows from rapidly increasing in the vicinity of the flow path outlet 12*b*. Accordingly, when the polishing fluid flows out from the flow path outlet 12*b*, the pressure of the flow path 12 in the vicinity of the flow path outlet 12*b* is prevented from decreasing. Therefore, also in the flow path outlet 12*b*, it is possible to favorably polish the inner peripheral surface 123 of the flow path 12.

Moreover, the elongation flow path 55 has the same constant flow path width W2 as the flow path width W1 of the flow path 12 in the flow path outlet 12*b*. Accordingly, it is possible to prevent the pressure of the polishing fluid from decreasing after the polishing fluid flows into the elongation flow path 55. Therefore, polishing conditions between the flow path outlet 12*b* and other portions of the flow path 12 can be brought closer to each other, and more uniform polishing can be performed.

In addition, the elongation flow path 55 linearly extends in the direction in which the flow path 12 extends at the flow path outlet 12*b*. Accordingly, it is possible to prevent a flow direction of the polishing fluid from being changed at the flow path outlet 12*b* and in the elongation flow path 55. If the flow direction of the polishing fluid is changed in the elongation flow path 55, the pressure of the polishing fluid at the flow path outlet 12*b* is changed. As a result, the polishing at the flow path outlet 12*b* may be adversely affected. Meanwhile, the flow path outlet 12*b* linearly extends to be elongated without curving the elongation flow path 55, and thus, it is possible to prevent the polishing at the flow path outlet 12*b* from being adversely affected. Therefore, more uniform polishing can be performed.

Hereinbefore, the embodiment of the present invention is described in detail with reference to the drawings. However, the respective configurations and combinations thereof in the embodiment are merely examples, and additions, omissions, substitutions, and other modifications of configurations are possible within a scope which does not depart from the gist of the present invention. In addition, the present invention is not limited by the embodiment, but is limited only by the claims.

For example, the shape, the material, or the like of the impeller 1 is not particularly limited.

In addition, when the flow path 12 is polished, the flow path elongation jig 50 is mounted outside the impeller 1 in the radial direction Dr. However, the flow path elongation jig

50 may be provided inside the impeller 1 in the radial direction Dr. In this case, it is preferable that the elongation flow path 55 communicates with the flow path inlet 12*a* so as to have the same flow path width as that of the flow path inlet 12*a*.

INDUSTRIAL APPLICABILITY

According to the above-described impeller manufacturing method and impeller flow path elongation jig, it is possible to favorably polish the inner peripheral surface of the flow path while forming the impeller by the additive manufacturing method.

REFERENCE SIGNS LIST

1: impeller
2: disk
2*a*, 2*b*: end portion
3: blade
4: cover
11: shaft insertion hole
12: flow path
12*a*: flow path inlet
12*b*: flow path outlet
23: curved surface
31, 32: end portion
33: intermediate portion
41: inner peripheral end portion
42: outer peripheral end portion
50: flow path elongation jig
51: jig body
52: first plate
53: second plate
54: partition member
54*w*: partition wall surface
55: elongation flow path
123: inner peripheral surface
123*s*: side wall surface
Dc: circumferential direction
Dr: radial direction
O: axis
S1: impeller forming step
S2: HIP processing step
S3: flow path polishing step
W1: flow path width
W2: flow path width

What is claimed is:

1. An impeller manufacturing method comprising:

an impeller forming step of integrally forming an impeller by an additive manufacturing method using a metal powder, the impeller including a disk which has a disk shape about an axis, a plurality of blades which are formed on a surface facing a first side in an axial direction of the disk with gaps therebetween in a circumferential direction about the axis, and a cover which covers the plurality of blades from the first side in the axial direction;

an HIP processing step of processing the impeller, after the impeller forming step, by a hot isostatic pressing (HIP); and a flow path polishing step of causing a polishing fluid containing abrasive grains to flow through a flow path formed between the disk, the cover, and the blades in the impeller after the HIP processing step while pressurizing the polishing fluid to perform fluid polishing, wherein in the flow path polishing step, a flow path elongation jig having an elongation flow path which extends to elongate the flow path by communicating with an outlet of the flow path is mounted radially outside the impeller and the fluid polishing is performed, in the flow path polishing step, the polishing fluid reciprocates in the flow path by flowing in the flow path while being pressurized from a flow path inlet of the flow path toward a flow path outlet of the flow path and while being pressurized from the flow path outlet toward the flow path inlet, when viewed in the axial direction, a flow path width of the elongation flow path in the circumferential direction is the same as a flow path width of the flow path at the flow path outlet in the circumferential direction, the elongation flow path extends with the flow path width constant, the flow path elongation jig comprises:

a first plate disposed to extend continuously from an end portion of the disk toward an outside in a radial direction in a state where the flow path elongation jig is mounted on the impeller;

a second plate disposed to extend continuously from an outer peripheral end portion of the cover toward the outside in the radial direction in the state where the flow path elongation jig is mounted on the impeller; and partition members, each of which is disposed to extend continuously from an outside end portion of each of the plurality of blades in the radial direction toward the outside in the radial direction in the state where the flow path elongation jig is mounted on the impeller, wherein each of the partition members comprises partition wall surfaces that are continuous to side wall surfaces of the flow path formed by the plurality of blades on both sides in the circumferential direction.

2. The impeller manufacturing method according to claim 1, wherein the elongation flow path is formed to linearly extend in a direction in which the flow path extends at the outlet of the flow path.

3. The impeller manufacturing method according to claim 1, wherein a length of the flow path elongation jig in a radial direction is equal to or more than the flow path width of the flow path at the flow path outlet.

* * * * *